US012115410B2

(12) United States Patent
Lagioia

(10) Patent No.: US 12,115,410 B2
(45) Date of Patent: Oct. 15, 2024

(54) EXERCISE APPARATUS

(71) Applicant: Christopher Alan Lagioia, Naperville, IL (US)

(72) Inventor: Christopher Alan Lagioia, Naperville, IL (US)

( * ) Notice: Subject to any disclaimer, the term of this patent is extended or adjusted under 35 U.S.C. 154(b) by 210 days.

(21) Appl. No.: 17/971,849

(22) Filed: Oct. 24, 2022

(65) Prior Publication Data

US 2024/0131389 A1 Apr. 25, 2024
US 2024/0226646 A9 Jul. 11, 2024

(51) Int. Cl.
*A63B 21/00* (2006.01)
*A63B 21/002* (2006.01)
*A63B 22/18* (2006.01)

(52) U.S. Cl.
CPC ..... *A63B 21/4034* (2015.10); *A63B 21/002* (2013.01); *A63B 22/18* (2013.01)

(58) Field of Classification Search
CPC . A63B 21/002; A63B 21/068; A63B 21/4015; A63B 21/4034; A63B 22/18; A63B 23/02; A63B 23/0227; A63B 69/0062
See application file for complete search history.

(56) References Cited

U.S. PATENT DOCUMENTS 3,586,321 A 6/1971 Gehrke
3,911,907 A * 10/1975 Smith, Jr. ..... A63B 23/03533 601/5
D241,863 S 10/1976 Friedl
4,613,131 A 9/1986 Anderson
4,801,140 A 1/1989 Bergeron
5,048,823 A 9/1991 Bean
5,603,662 A 2/1997 Kreaman-Stern
5,730,690 A * 3/1998 Guidry ..... A63B 22/18 482/146
6,019,712 A 2/2000 Duncan
6,551,225 B1 4/2003 Romero
(Continued)

FOREIGN PATENT DOCUMENTS

JP 6552025 7/2019

OTHER PUBLICATIONS

NPL-5 BOSU Ball Exercises For Cyclists, Susan Grant Legacki, https://www.active.com/fitness/articles/5-bosu-ball-exercises-for-cyclists?page=3.

*Primary Examiner* — Joshua Lee
(74) *Attorney, Agent, or Firm* — The Law Offices of Konrad Sherinian LLC; Depeng Bi

(57) ABSTRACT

A convertible side plank and balance exercise device includes a platform and a base extending rearwardly from the platform. The convertible exercise device has a circular or oval front perimeter that extends around the platform. The base has a domed rear surface. A front side of the device includes left and right footwells for receiving a left shoe and a right shoe when the device is in a side plank exercise configuration. The device further includes removable left and right footwell inserts that are removably insertable into the footwells to provide a flat front surface on the front side of the device in a balance exercise configuration. The base includes an air chamber with an inflation and deflation valve and a distensible rear panel comprising the domed rear surface, the rear panel collapsing for storage and shipping when the air chamber is deflated.

9 Claims, 3 Drawing Sheets

(56) References Cited

U.S. PATENT DOCUMENTS

| | | | | |
|---|---|---|---|---|
| 6,575,885 | B1 * | 6/2003 | Weck | A63B 21/0004 482/148 |
| 7,137,938 | B2 | 11/2006 | Gottlieb | |
| 7,357,766 | B2 | 4/2008 | Langer | |
| 8,105,218 | B1 | 1/2012 | Vayntraub | |
| 8,226,533 | B2 * | 7/2012 | Wessels | A63B 26/00 482/141 |
| 8,382,645 | B2 | 2/2013 | Mylrea | |
| 8,444,532 | B1 | 5/2013 | Barcena | |
| 8,678,985 | B2 * | 3/2014 | Mattox | A63B 21/0004 482/148 |
| 8,814,768 | B1 | 8/2014 | Yang et al. | |
| 9,320,940 | B2 | 4/2016 | Rainey | |
| 10,220,243 | B2 | 3/2019 | Koegel | |
| D848,623 | S * | 5/2019 | Franche | D24/188 |
| D870,828 | S | 12/2019 | Dicharry | |
| 10,843,039 | B2 * | 11/2020 | Dicharry | A63B 21/00069 |
| 10,894,180 | B2 * | 1/2021 | Osti | A63B 26/003 |
| 2003/0148865 | A1 * | 8/2003 | Handshoe | A63B 22/18 482/79 |
| 2007/0298947 | A1 | 12/2007 | Eksteen | |
| 2009/0215596 | A1 | 8/2009 | Obermaier | |
| 2013/0288866 | A1 * | 10/2013 | Rainey | A63B 22/18 482/146 |
| 2016/0220862 | A1 * | 8/2016 | Johnson | A63B 21/068 |
| 2016/0250520 | A1 * | 9/2016 | Rainey | A63B 22/18 482/146 |

* cited by examiner

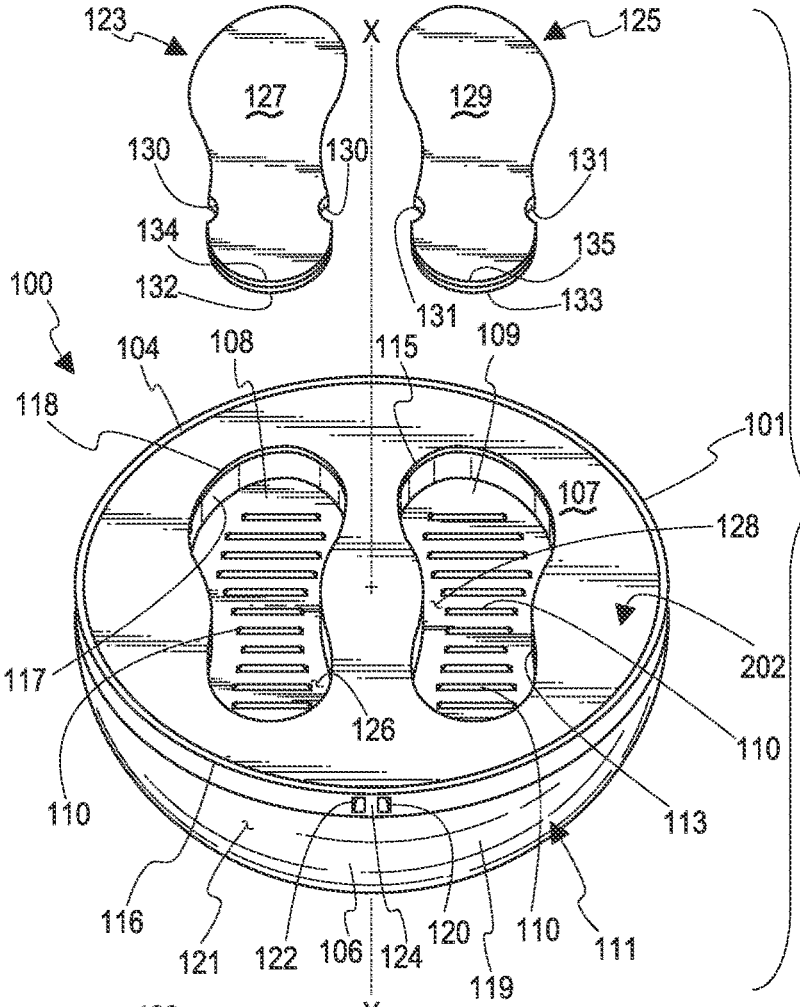
Fig. 1A
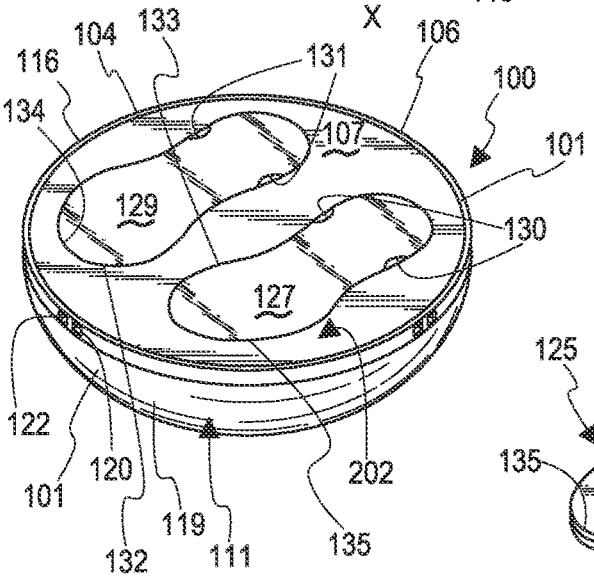
Fig. 1B
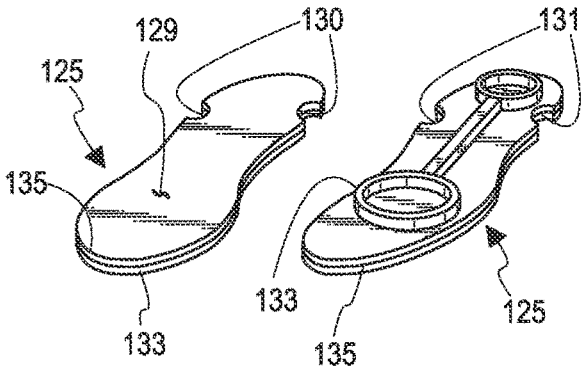
Fig. 1C
Fig. 1D

EXERCISE APPARATUS

CROSS REFERENCE TO RELATED APPLICATIONS

This application is related to U.S. patent application Ser. No. 17/732,881, entitled "EXERCISE APPARATUS", filed Apr. 29, 2022, which is a continuation of U.S. patent application Ser. No. 16/992,326, entitled "EXERCISE APPARATUS", filed Aug. 13, 2020, which is a continuation-in-part of U.S. patent application Ser. No. 16/846,352, entitled "EXERCISE APPARATUS," filed Apr. 12, 2020, all of which are hereby incorporated by reference in their respective entireties.

FIELD OF THE DISCLOSURE

The present invention generally relates to a physical exercise apparatus, and more particularly relates to a side plank exercise device that can also be used for balance and stability exercises.

DESCRIPTION OF BACKGROUND

An existing side plank exercise device also serves multiple other types of exercises, including standing balance and stability exercises. The existing device includes a generally flat platform and a generally domed base. The platform incorporates a pair of recessed footwells, which serve to receive a user's shoes and to bear a portion of the user's weight directed mediolaterally from the sides of the shoes to the device when used to support a side plank exercise. However, the footwells make the top surface of the platform uneven and thus can limit the user's choice of comfortable stances or foot positions when a user stands on the platform to perform a balance exercise. A need therefore exists for an exercise device that supports a side plank exercise when oriented sideways and, when oriented upright, supports standing balance and stability exercises performed with various different foot positions.

SUMMARY OF THE DISCLOSURE

Generally speaking, pursuant to the various embodiments, the present disclosure provides an exercise device including a front side, a rear side, and an axis extending in forward and rearward longitudinal directions; a platform disposed on the front side, the platform having a front surface lying generally in a frontal plane; a base disposed on the rear side, the base being connected to and extending rearwardly from the platform, the base comprising a convex curved rear surface; a device front edge, the device front edge having a circular or oval perimeter, the platform being disposed within the perimeter of the device front edge when viewed in the frontal plane; a pair of footwells disposed on the front side, the footwells comprising a left footwell and a right footwell, the left and right footwells respectively comprising a left and a right footbed surface, footwell sidewall, and footwell opening, each footwell sidewall extending peripherally around a perimeter of the corresponding footbed surface and forwardly from the footbed surface perimeter to a perimeter of the corresponding footwell opening, each recessed volume being bounded peripherally by the corresponding footwell sidewall and extending rearwardly from the corresponding footwell opening to the corresponding footbed surface, the recessed volumes lying within an area circumscribed by the device front edge when viewed in the frontal plane, the pair of footwells being operative to receive simultaneously a user's left shoe and right shoe, respectively; and a left footwell insert and a right footwell insert, each footwell insert having a front surface and a rear side, the left footwell insert being removably insertable into the left footwell and the right footwell insert being removably insertable into the right footwell, such that the front surface of each inserted footwell insert aligns with the platform front surface to form a substantially uninterrupted flat front surface of the device in the frontal plane. Further in accordance with the present teachings is an exercise device including a front side, a rear side, and an axis extending in forward and rearward longitudinal directions; a rounded front edge; a platform, the platform being disposed on the device front side, the platform having a front surface lying generally in a frontal plane within a perimeter of the rounded front edge of the exercise device; a distensible rear panel, the rear panel being disposed on the device rear side, the rear panel being connected to and extending rearwardly from the platform; a pair of footwells, the footwells being disposed on the device front side, the footwells comprising a left footwell and a right footwell, the left and right footwells respectively comprising a left and a right footbed surface, footwell sidewall, and footwell opening, each footwell sidewall extending peripherally around a perimeter of the corresponding footbed surface and forwardly from the footbed surface perimeter to a perimeter of the corresponding footwell opening, each recessed volume being bounded peripherally by the corresponding footwell sidewall and extending rearwardly from the corresponding footwell opening to the corresponding footbed surface, the recessed volumes lying within an area circumscribed by the device front edge when viewed in the frontal plane, the left and right footwell being operative to receive simultaneously a left shoe and a right shoe of a user, respectively; an inflatable air chamber, the air chamber being disposed rearwardly of the platform and forwardly of the rear panel, the rear panel having an outer surface and an inner surface, the rear panel inner surface being in fluid communication with the air chamber; and a valve, the valve being in fluid communication with the air chamber, being operative to permit the air chamber to be inflated and deflated through the valve and to passively seal the air chamber during normal use of the device, the rear panel being adapted and configured to be distended when the air chamber is inflated, such that the rear panel outer surface assumes a dome shape, and to be collapsible when the air chamber is deflated, so as to permit the device to be compressed to a reduced longitudinal dimension.

BRIEF DESCRIPTION OF THE DRAWINGS

Although the characteristic features of this disclosure will be particularly pointed out in the claims, the invention itself, and the manner in which it may be made and used, may be better understood by referring to the following description taken in connection with the accompanying drawings forming a part hereof, wherein like reference numerals refer to like parts throughout the several views and in which:

FIG. 1A is an exploded top-rear perspective view of an exercise device in accordance with this disclosure.

FIG. 1B is an assembled top-front-left perspective view of an exercise device in accordance with this disclosure.

FIG. 1C is a top-left-front perspective view of a left footwell insert of an exercise device in accordance with this disclosure.

FIG. 1D is a bottom-right-front perspective view of a right footwell insert of an exercise device in accordance with this disclosure.

Figure 2A:
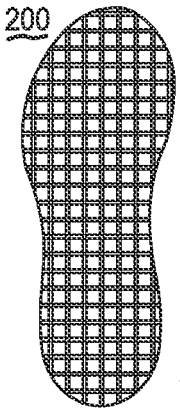
FIG. 2A is a top view of a footbed tread of an exercise device in accordance with this disclosure.

A person of ordinary skill in the art will appreciate that elements of the figures above are illustrated for simplicity and clarity and are not necessarily drawn to scale. The dimensions of some elements in the figures may have been exaggerated relative to other elements to help understanding of the present teachings. Furthermore, a particular order in which certain elements, parts, components, modules, steps, actions, events and/or processes are described or illustrated may not be actually required. A person of ordinary skills in the art will appreciate that, for the purpose of simplicity and clarity of illustration, some commonly known and well-understood elements that are useful and/or necessary in a commercially feasible embodiment may not be depicted in order to provide a clear view of various embodiments in accordance with the present teachings.

DETAILED DESCRIPTION

Turning to the Figures, a convertible exercise device 100, for use in supporting side plank and standing balance exercises, is shown and described here. As shown in FIG. 1A, the convertible exercise device 100 has a front end 101 on a front side and a rear end 106 on a rear side, and an axis X, the axis X extending in forward and rearward longitudinal directions and defining radial directions perpendicular to the axis X. The device 100 includes a platform 102 disposed on the front side of the device and a domed base 111 connected to a rear side of the platform 102. The platform 102 having a front surface 107, the front surface 107 lying in a frontal plane perpendicular to the axis X. In the illustrated embodiment, the front surface 107 is flat. In other embodiments, a front surface is generally flat but may include traction tread features, similarly to those of the below described footbeds. A left footwell 108 and a right footwell 109 are disposed on a front side of the platform 102. The left and right footwells 108, 109 merge with the front surface 107 of the platform 102 at respective contours 112 and 113, which form the perimeters of respective left and right footwell openings 114, 115 of the footwells 108, 109.

The device 100 further comprises a left footwell insert 123 and a right footwell insert 125 (generally mirror images of each other), as shown in the exploded view of FIG. 1A and the assembled view of FIG. 1B, and separately in FIGS. 1C and 1D. The left and right footwell inserts 123, 125 have respective front surfaces 127, 129. The inserts 123, 125 are operative to be removably inserted in the corresponding footwells 108, 109. When inserted, the front surfaces 127, 129 of the inserts 123, 125 align with the platform front surface 107 in the frontal plane, to form a flat surface on the front side of the device 100 for a user to stand on when performing balance and stability exercises, as seen in FIG. 1B. In addition, the illustrated left and right inserts 123, 125 are constructed of a left and right hard insert body 132, 133 and a left and right insert footpad 134, 135 attached to a front side of the insert body 132, 133, as best seen in FIGS. 1C and 1D.

The respective perimeters of the front surfaces 127, 129 at least substantially conform to the shapes of the contours 112, 113 so that the standing surface is essentially uninterrupted. However, each insert 123, 125 as illustrated includes a corresponding pair of cut-out indents 130, 131 on its opposite mediolateral sides, to facilitate grasping the insert between two fingers for removal. In other embodiments, an upper/frontal portion of a footwell insert, and/or of a device platform, is sufficiently compressible for the insert to be pried out by the user's fingertips without providing any cut-out indent at the insert perimeter. Optionally, the inserts 123, 125 can be retained in the footwells 108, 109 by clip connectors (not shown). In other embodiments, the inserts 123, 125 can be retained by friction.

The device 100 has a rounded peripheral front edge 104, which is said to surround the platform 102 in that the frontal planar profile of the platform 102 lies entirely within that of the front edge 104. In the illustrated embodiment, the front edge 104 is circular. In other embodiments, a device front edge can be elliptical or an otherwise rounded, convex closed shape lying in a plane.

In the illustrated embodiment, the platform 102 is constructed of a hard platform body 117, a compressible footpad 118 attached to a front side of the platform body 117, and a bracket ring 116 that surrounds the peripheries of the platform body 117 and footpad 118. As seen in FIGS. 1A, 1B, the bracket ring 116 comprises the front edge 104 and front end 101 of the device 100. The front end 101 may lie in or slightly forward of the frontal plane, for example, by a flange thickness of the bracket ring 116. In other embodiments, an exercise device platform can be a one-piece member whose perimeter comprises a front peripheral edge of a corresponding exercise device. In a further implementation, the bracket ring 116 incorporates a strap attachment point 120 for attaching a strap to the convertible exercise device 100. The attachment point 120 includes a cavity 122 formed behind hitch bar 124, with openings to the cavity 122 exposed on two sides of the hitch bar 124 on an outer surface of the bracket ring 116. Thus, for example, a strap can be tied directly to the hitch bar 124 or a carabiner attached to the strap can be connected to the hitch bar 124.

The footwells 108, 109 are adapted to receive a pair of shoes of a user of the convertible exercise device 100. The left footwell 108 is configured for receiving a user's left shoe while the right footwell 109 is configured for receiving a user's right shoe. In one implementation, the footwells 108, 109 are configured in the general shape of male shoes, such as sneakers and running shoes. In an alternative embodiment, the footwells 108, 109 are configured in the general shape of female shoes, such as sneakers and running shoes.

In one embodiment, a depth of the footwells 108, 109 is about two inches over the majority of the area of a respective footbed surface 126, 128. In a further implementation, to increase the area of contact between the shoes and the bottom surfaces of the footwells 108, 109, the depth of the footwell 108, 109 becomes gradually shallower in a toe region towards a toe end. In addition, the depth of a middle region of a each of the footwells 108, 109, corresponding to the position of a medial arch of a left or right foot, also tapers upward to be less than two inches towards a medial side of the footwell 108, 109. In such a case, the footwells 108, 109 are said to match the natural shapes of exercise shoes (such as running shoes and sneakers) and are uneven in depth.

Figure 2B:
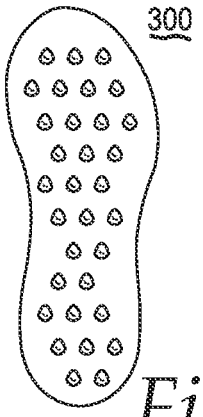
FIG. 2B is a top view of a grip of another footbed tread of an exercise device in accordance with this disclosure.

The footwells 108, 109 each can further incorporate a tread 110 for improving the traction force between the shoes and the convertible exercise device 100. The tread 110 includes a set of protruding parallel ridges. The tread 110 can also be constructed in different shapes or patterns. As shown in FIG. 2A, a tread 200 includes two sets of protruding parallel ridges that cross each other, and as shown in FIG. 2B, a tread 202 includes an array of rounded raised bumps.

The base 111 comprises a rear panel 119 with a dome shaped outer surface 121, the rear end 106 being an apex of the rear panel outer surface 121, located on the axis X. More particularly, the outer surface 121 is a portion of a sphere (i.e., a spherical cap), which may comprise a hemisphere or more or less than the hemisphere corresponding to a sphere. In other embodiments, an outer surface of an exercise device base is more generally a convex curved surface of a shape that can roll or tilt in multiple directions (e.g., in all directions) over a floor surface on which the base rests. In a further implementation, an inflatable air chamber (not shown) is disposed in front of the rear panel 119, and the base 111 further includes an inflation valve 138. The inflation valve 138 is illustrated as being disposed on a rear/outer side of the rear panel 119, although an inflation valve can alternatively be disposed directly behind an opening or removable piece of an exercise device platform for access from a front side of the exercise device. The inflation valve 138 can for example, include a standard air plug stopper removable by a standard extractor, as commonly used in yoga balls and other exercise balls, permitting the valve to be selectively opened for inflation and deflation, and otherwise closed to keep the air chamber sealed. The rear panel 119 is distensible, so as to assume and substantially retain the illustrated dome shape when the air chamber is inflated for use, and so as to be collapsible to contract a longitudinal dimension of the device 100 when the air chamber is deflated, for example for purposes of shipping or long-term storage of the device 100.

The convertible exercise device 100 can be made of various suitable materials or combinations of materials with suitable strength, stiffness, resiliency, compressibility, hardness, and other properties, for example, hard plastics such as ABS or HDPE, solid or foam rubbers/elastomers such as silicone or EVA foam. In one implementation, the platform body 117 is made of molded ABS plastic, which can be infused with fiberglass, while the footpad 118 is made of silicone or other rubber. In a further implementation, the rear panel 119 of the base 111 is a distensible member made of silicone or other rubber.

Figure 3:
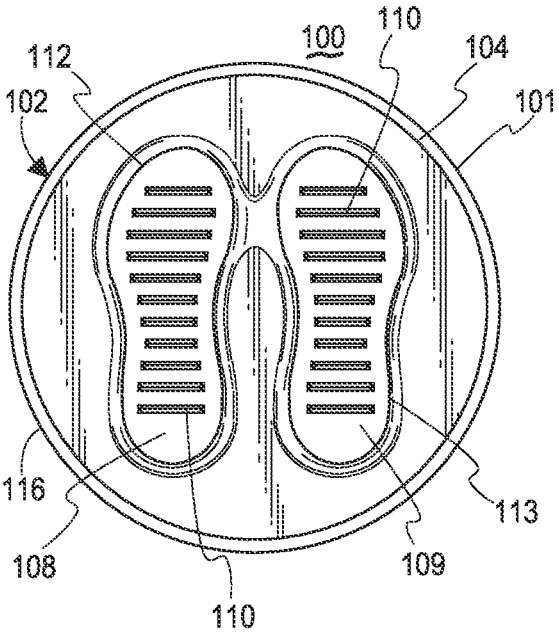
FIG. 3 is a top view of an exercise device in accordance with this disclosure.
Figure 4:
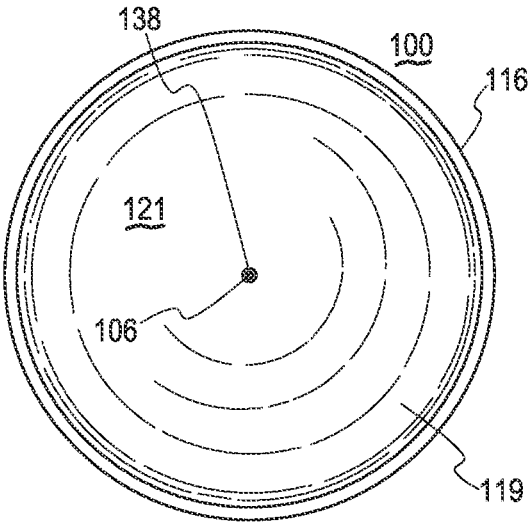
FIG. 4 is a bottom view of an exercise device in accordance with this disclosure.
Figure 5:
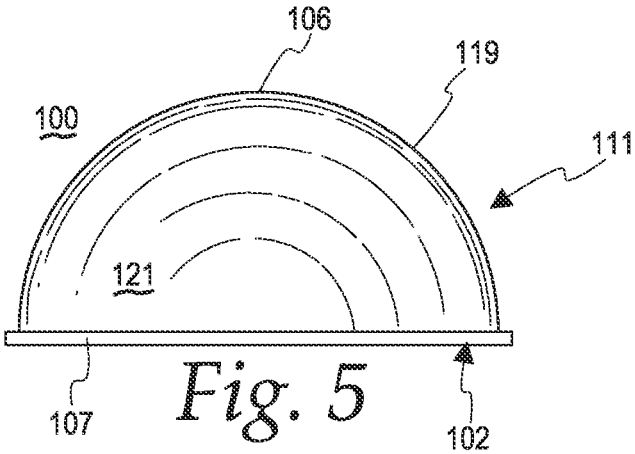
FIG. 5 is a side view of an exercise device in accordance with this disclosure.

FIG. 3 shows a front view of the convertible exercise device 100. FIG. 4 shows a rear view of the convertible exercise device 100. A side view of the convertible exercise device 100 is shown in FIG. 5. The side surface of the convertible exercise device 100 is indicated at 502.

Figure 6:
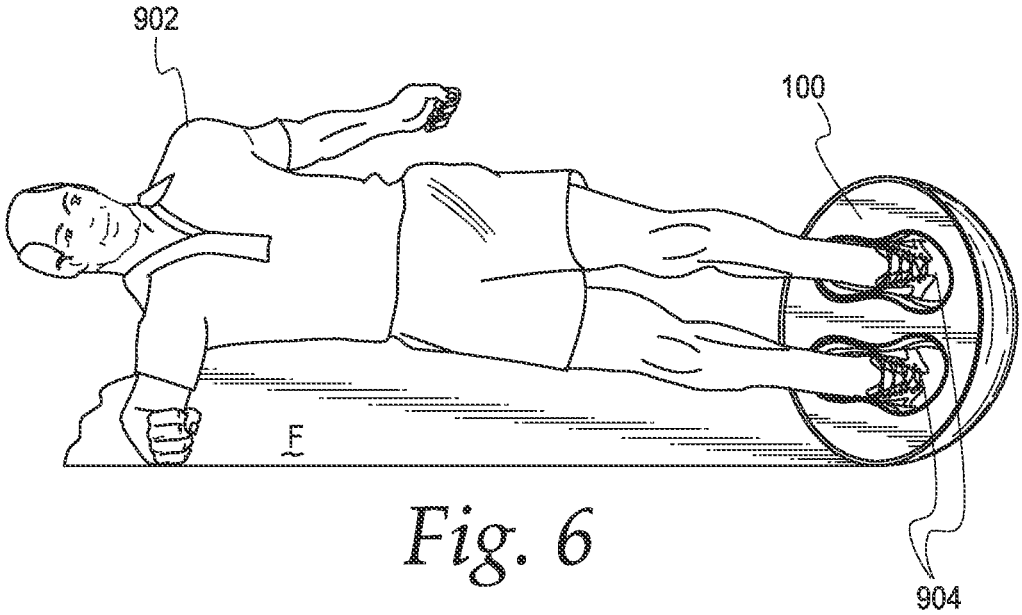
FIG. 6 is a front view of a user doing a side plank exercise using an exercise device in accordance with this disclosure.

To use the convertible exercise device 100 for a side plank exercise, a user first places her/his feet and shoes into the footwells 108, 109, and then performs other steps of a conventional side plank exercise. A side perspective view of the user performing a side plank exercise using the convertible exercise device 100 is shown in FIG. 6. The user is indicated at 902 while the shoes are indicated at 904.

With the shoes 904 disposed inside the footwells 108, 109, they are above the exercise floor, and thus cause more stress on oblique abdominal muscles and other muscles. The increased stress improves the efficiency of the side plank exercise. In addition, the user 902 can operate her/his feet to rotate the convertible exercise device 100 such that the shoes 904 are flat or tilted at an angle to the exercise floor. The tilting further allows the user 904 to strengthen muscles that are not exercised or not greatly exercised in conventional side plank exercises. In addition, the tilting of her/his feet improves strengthening of oblique abdominal muscles, adductor longus muscles, tensor fasciae latae muscles and other muscles that are targeted in conventional side plank exercises. To switch from left to right or right to left, the user 902 simply rotates the convertible exercise device 100 by about 180 degrees.

Figure 7:
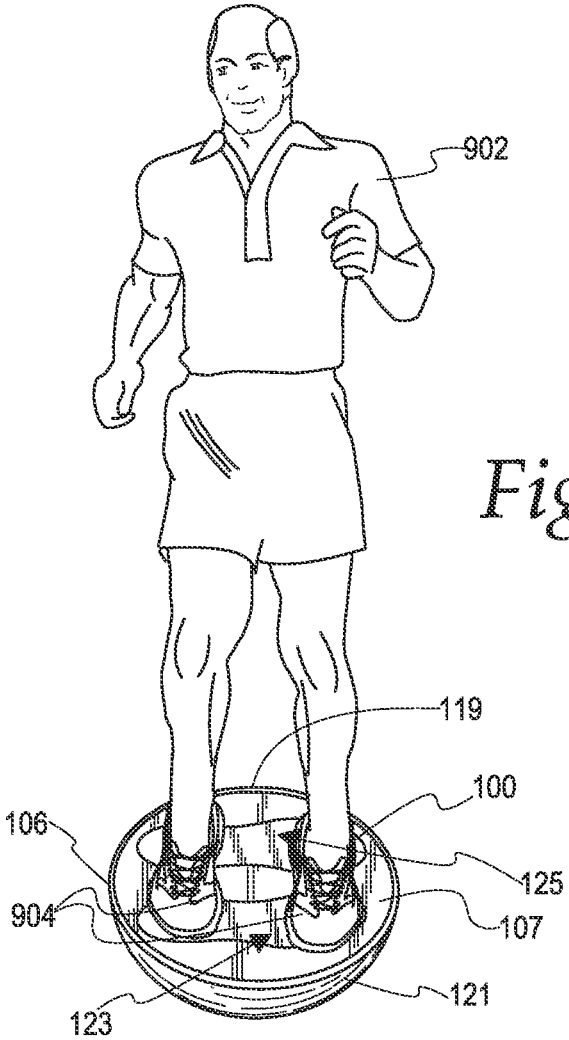
FIG. 7 is a front view of a user doing a balance exercise using a new exercise apparatus in accordance with this disclosure.

The convertible exercise device 100 can also be operated for balance and stability exercises, as shown in FIG. 7. To do so, the user 902 places the convertible exercise device 100 on an exercise floor with its rear end 106 making contact with the exercise floor, and steps onto the platform front surface 107. The outer surface 121 of the rear panel 119 is in a dome shape to provide three hundred sixty degrees of free tilting movement of the device 100.

The foregoing description of the disclosure has been presented for purposes of illustration and description and is not intended to be exhaustive or to limit the disclosure to the precise form disclosed. The description was selected to best explain the principles of the present teachings and practical application of these principles to enable others skilled in the art to best utilize the disclosure in various embodiments and various modifications as are suited to the particular use contemplated. It should be recognized that the words "a" or "an" are intended to include both the singular and the plural. Conversely, any reference to plural elements shall, where appropriate, include the singular.

It is intended that the scope of the disclosure not be limited by the specification, but be defined by the claims set forth below. In addition, although narrow claims may be presented below, it should be recognized that the scope of this invention is much broader than presented by the claim(s). It is intended that broader claims will be submitted in one or more applications that claim the benefit of priority from this application. Insofar as the description above and the accompanying drawings disclose additional subject matter that is not within the scope of the claim or claims below, the additional inventions are not dedicated to the public and the right to file one or more applications to claim such additional inventions is reserved.

What is claimed is:

1. An exercise device comprising:

a front side, a rear side, and an axis extending in forward and rearward longitudinal directions;

a platform disposed on the front side, the platform having a front surface lying generally in a frontal plane;

a base disposed on the rear side, the base being connected to and extending rearwardly from the platform, the base comprising a convex curved rear surface;

a device front edge, the device front edge having a circular or oval perimeter, the platform being disposed within the perimeter of the device front edge when viewed in the frontal plane;

a pair of footwells disposed on the front side, the footwells comprising a left footwell and a right footwell, the left and right footwells respectively comprising a left and a right footbed surface, footwell sidewall, and footwell opening, each footwell sidewall extending peripherally around a perimeter of the corresponding footbed surface and forwardly from the footbed surface perimeter to a perimeter of the corresponding footwell opening, each recessed volume being bounded peripherally by the corresponding footwell sidewall and extending rearwardly from the corresponding footwell opening to the corresponding footbed surface, the recessed volumes lying within an area circumscribed by the device front edge when viewed in the frontal plane, the pair of footwells being operative to receive simultaneously a user's left shoe and right shoe, respectively;

a left footwell insert and a right footwell insert, each footwell insert having a front surface and a rear side, the left footwell insert being removably insertable into the left footwell and the right footwell insert being removably insertable into the right footwell, such that the front surface of each inserted footwell insert aligns with the platform front surface to form a substantially uninterrupted flat front surface of the device in the frontal plane.

2. The exercise device of claim 1 wherein the footwells are disposed within an area bounded by the front edge as viewed in the frontal plane.

3. The exercise device of claim 1 wherein, when the left and right footwell inserts are inserted into the corresponding left and right footwells, the footwell front surfaces and the platform front surface are operative to be substantially equally compressible in the longitudinal dimension.

4. The exercise device of claim 1 wherein the rear surface of the base is operative to contact a floor surface so as to permit the device to tilt in all directions relative to the floor surface.

5. The exercise device of claim 4 wherein, when the left and right footwell inserts are inserted into the corresponding left and right footwells, and the device is supported by the rear surface of the base on a floor surface, the device is operative to support a user standing on the platform front surface of the device, with at least one of the user's feet overlying a portion of the platform front surface and a portion of at least one of the footwell insert front surfaces, to perform a balance exercise in which the user attempts to maintain the platform front surface of the device parallel to the floor surface.

6. The exercise device of claim 1 wherein, when the device is used to support a user performing a left side plank exercise, the left and right footwell inserts is removed and the user's left and right feet are received by the left and right footwells, respectively, the device is supported on a horizontal floor surface, the user's left arm is supported on the horizontal floor surface, the device is tilted so that the footbed surfaces are inclined relative to the floor surface, the left footwell is disposed below the right footwell, the left footwell sidewall is operative to bear a portion of the user's weight directed laterally from a lateral side of the user's left shoe, and the right footwell sidewall is operative to bear a portion of the user's weight directed medially from a medial side of the user's right shoe; and when the device is used to support a user performing a right side plank exercise, the left and right footwell inserts is removed and the user's left and right feet are received by the left and right footwells, respectively, with the device being supported on a horizontal floor surface, the user's right arm is supported on the horizontal floor surface, the device is tilted so that the footbed surfaces are inclined relative to the floor surface, the right footwell is disposed below the left footwell, the right footwell sidewall is operative to bear a portion of the user's weight directed laterally from a lateral side of the user's right shoe, and the left footwell sidewall is operative to bear a portion of the user's weight directed medially from a medial side of the user's left shoe.

7. The exercise device of claim 6 wherein, when the device is used to support a user performing said left side plank exercise and said right side plank exercise, the device front edge is operative to contact the floor surface so as to transmit a weight of the device and said portions of the weight of the user to the floor surface.

8. An exercise device comprising:

a front side, a rear side, and an axis extending in forward and rearward longitudinal directions;

a rounded front edge;

a platform, the platform being disposed on the device front side, the platform having a front surface lying generally in a frontal plane within a perimeter of the rounded front edge of the exercise device;

a distensible rear panel, the rear panel being disposed on the device rear side, the rear panel being connected to and extending rearwardly from the platform;

a pair of footwells, the footwells being disposed on the device front side, the footwells comprising a left footwell and a right footwell, the left and right footwells respectively comprising a left and a right footbed surface, footwell sidewall, and footwell opening, each footwell sidewall extending peripherally around a perimeter of the corresponding footbed surface and forwardly from the footbed surface perimeter to a perimeter of the corresponding footwell opening, each recessed volume being bounded peripherally by the corresponding footwell sidewall and extending rearwardly from the corresponding footwell opening to the corresponding footbed surface, the recessed volumes lying within an area circumscribed by the device front edge when viewed in the frontal plane, the left and right footwell being operative to receive simultaneously a left shoe and a right shoe of a user, respectively;

an inflatable air chamber, the air chamber being disposed rearwardly of the platform and forwardly of the rear panel, the rear panel having an outer surface and an inner surface, the rear panel inner surface being in fluid communication with the air chamber;

a valve, the valve being in fluid communication with the air chamber, and being operative to permit the air chamber to be inflated and deflated through the valve and to passively seal the air chamber during normal use of the device, the rear panel being adapted and configured to be distended when the air chamber is inflated, such that the rear panel outer surface assumes a dome shape, and to be collapsible when the air chamber is deflated, so as to permit the device to be compressed to a reduced longitudinal dimension.

9. The device of claim 8 wherein an entirety of the rear panel is disposed behind the platform front surface.

* * * * *